US007842896B1

(12) United States Patent
Calcoen et al.

(10) Patent No.: US 7,842,896 B1
(45) Date of Patent: Nov. 30, 2010

(54) APPARATUS AND METHOD FOR SORTING ARTICLES

(75) Inventors: Johan Calcoen, Lueven (BE); Carlo Janssens, Londerzeel (BE); Jeroen J. W. Erinkveld, Nijmegen (NL)

(73) Assignee: Key Technology, Inc., Walla Walla, WA (US)

( * ) Notice: Subject to any disclaimer, the term of this patent is extended or adjusted under 35 U.S.C. 154(b) by 291 days.

(21) Appl. No.: 12/150,211

(22) Filed: Apr. 25, 2008

Related U.S. Application Data

(60) Provisional application No. 60/926,246, filed on Apr. 25, 2007.

(51) Int. Cl.
*B07C 5/00* (2006.01)

(52) U.S. Cl. ..... 209/576

(58) Field of Classification Search ..... 209/576–582, 209/939

See application file for complete search history.

(56) References Cited

U.S. PATENT DOCUMENTS 4,535,248 A 8/1985 Schade et al.
4,634,881 A 1/1987 Billion
5,443,164 A * 8/1995 Walsh et al. ..... 209/580
5,502,559 A * 3/1996 Powell et al. ..... 356/73
5,555,984 A * 9/1996 Sommer et al. ..... 209/580
5,887,073 A 3/1999 Fazzari et al.
6,080,950 A 6/2000 Jalink
6,137,074 A * 10/2000 Doak ..... 209/581
6,313,423 B1 11/2001 Sommer et al.
6,335,501 B1 * 1/2002 Khalfan ..... 209/582
6,497,324 B1 * 12/2002 Doak et al. ..... 209/522
6,734,383 B1 5/2004 Colcoen et al.
6,795,179 B2 * 9/2004 Kumar ..... 356/318
7,081,594 B1 * 7/2006 Khalfan et al. ..... 209/578
7,499,172 B2 * 3/2009 Doak et al. ..... 356/448

* cited by examiner

*Primary Examiner*—Joseph C Rodriguez
(74) *Attorney, Agent, or Firm*—Wells St. John P.S.

(57) ABSTRACT

An apparatus and method for selectively removing or sorting undesirable articles wherein a product stream is transported by a conveyor, and then interrogated by an optical scanner and sorting processor to inspect and label the articles according to user specified criteria. Articles labeled or classified as undesirable articles are removed by an ejector or removal station while desirable or acceptable articles are passed.

16 Claims, 5 Drawing Sheets

APPARATUS AND METHOD FOR SORTING ARTICLES

CROSS-REFERENCES TO RELATED APPLICATIONS

This application claims priority to provisional application No. 60/926,246, filed on Apr. 25, 2007, the disclosures of which are incorporated herein.

BACKGROUND OF THE INVENTION

Methods and machines for sorting articles have been known in the art for many years and are useful for separating desirable and undesirable articles from a product stream using a variety of methods. The machines found in the art include types that utilize reflecting electromagnetic radiation in the form of light to determine the optical reflective characteristics of the articles in the product stream using color as a determinant. A notable example of such a sorter is the High Speed Mass Flow Sorting Apparatus for Optically Inspection and Sorting Bulk Food Products as shown in U.S. Pat. No. 5,887,073 assigned to Key Technology, Inc. Another notable example of an exemplary sorter is shown in copending patent application Ser. No. 11/392,947 filed on Mar. 30, 2006 the disclosures of which are incorporated by reference herein.

Some methods and machines for sorting articles utilize emitted light from articles to be sorted in an effort to make a determination between desirable and undesirable articles. Often, it is desirable for a sorting apparatus to include an ability to distinguish between organic and inorganic articles. It is known in the art that chlorophyll produces a fluorescence emission in response to an excitation wavelength. Chlorophyll is an essential molecule during photosynthesis and is present in varying forms in many plants, including many comestible articles such as green beans and peas.

An example of a machine or method that exploits this property is disclosed in U.S. Pat. No. 6,734,383. Here, light is cast onto articles in a product stream and a passed in front of a fluorescent or backlit background element. In this example, the emission from the background is selected to be within an order of magnitude of the emission of the desirable articles which are presumed to emit light due to their chlorophyll response. This approach provides a clear distinction between desirable articles that emit light and undesirable non-emitting articles, effectively reducing a sorting decision to a basic thresholding operation.

This approach, while simple, suffers from a number of shortcomings. One specific shortcoming that limits the widespread application of this machine or method is the fact that different types of articles, varieties of articles, and even the manner in which the articles are prepared can have a profound impact on the magnitude of the light that is emitted by fluorescence from the articles. This reality requires that the background element be carefully selected or tuned for a specific application. In a typical food processing line, it is common that multiple types of articles, varieties of articles, and methods of treatment of the articles are utilized over the course of operation to satisfy both the supply and market needs. This situation requires that the machine operator have at their disposal an appropriate background element for each situation. In addition, this presents an additional burden on the manufacturer of the machine to design and produce a family of background elements, each tuned to a specific situation.

The present invention overcomes this and other limitations of the prior art, and is equipped with a background element that does not fluoresce or emit light. The invention utilizes an expanded capability of gathering and manipulating light emitted and returned by articles in a product stream, and light returned by a passive background element. This expanded capability is realized by devoting one channel of an optical scanner to measuring light emitted from articles, another channel for measuring reflected light from the articles and background element, and another channel for measuring light that is reflected and scattered to some degree by the articles and the background element. A sorting processor receives the measurements from these channels and logically combines them with previously defined and user identified criteria to make a determination whether or not an article is an acceptable or unacceptable article.

SUMMARY OF THE INVENTION

One aspect of the invention is a sorting apparatus for selectively removing undesirable articles from a product stream, including a conveyor positioned in transporting relation to the product stream, and a removal station positioned proximate to the product stream. The invention also includes a background element positioned proximate to the product stream, and an optical scanner configured to project electromagnetic radiation having a preponderance of energy at a first wavelength onto the product stream and the background element. In addition, the invention includes a first sensor configured to convert light or electromagnetic radiation returned from articles in the product stream having a wavelength that is longer than the first wavelength into a first signal, a second sensor configured to convert light or electromagnetic radiation having the first wavelength that is reflected by articles in the product stream and from the background element into a second signal, a third sensor configured to convert light or electromagnetic radiation having the first wavelength that is scattered by articles in the product stream and from the background element into a third signal, a sorting processor connected to the removal assembly and operable to receive the first, second, and third signals, and a user interface connected in data communication to the sorting processor.

Another aspect of the invention includes a sorting apparatus for selectively removing undesirable articles from a product stream, having a conveyor positioned in transporting relation to the product stream, a removal station positioned proximate to the product stream, a background element positioned proximate to the product stream, and a scanning assembly configured to project light or electromagnetic radiation onto the product stream and the background element, and further configured to receive light or electromagnetic radiation that is reflected by the background element, and to receive light or electromagnetic radiation that is reflected and/or emitted by articles in the product stream, and wherein the scanning assembly is configured to emit light or electromagnetic energy having a preponderance of energy at a first wavelength. In the invention, the scanning assembly further includes a first channel configured to measure light or electromagnetic radiation returned from articles in the product stream having a wavelength that is longer than the first wavelength, a second channel configured to measure light or electromagnetic radiation reflected by articles in the product stream and from the background, and a third channel configured to measure light or electromagnetic radiation that is scattered by articles in the product stream and from the background. The invention also includes a sorting processor connected to the scanning assembly and removal assembly, and operable to receive data from the scanning assembly, and operable to provide a virtual image of the articles wherein colors are assigned to each of the first, second, and third channels of the scanning assembly, and wherein the sorting processor is further operable to compare this data with user defined sorting criteria operable to classify articles in the product stream as either undesirable articles or acceptable articles, and further operable to transform the classification of articles into specific sequenced commands that control the removal station to selectively remove undesirable articles from the product stream.

Yet another aspect of the invention includes a sorting method for selectively removing undesirable articles from a product stream, which includes providing an optical scanner, a sorting processor in signal communication with the optical scanner, and a passive background element positioned proximate to the product stream. The invention further includes projecting electromagnetic radiation from the optical scanner having a preponderance of energy at a first wavelength onto the product stream and the background element, and converting light or electromagnetic radiation returned from articles in the product stream having a wavelength that is longer than the first wavelength into a first signal by the optical scanner, and converting light or electromagnetic radiation having the first wavelength that is reflected by articles in the product stream and from the background element into a second signal by the optical scanner, and then converting light or electromagnetic radiation having the first wavelength that is scattered by articles in the product stream and from the background element into a third signal by the optical scanner; and transforming each of the first, second, and third signals into a first, second, and third data stream that is representative of the time varying magnitude of each of the signals in the sorting processor.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
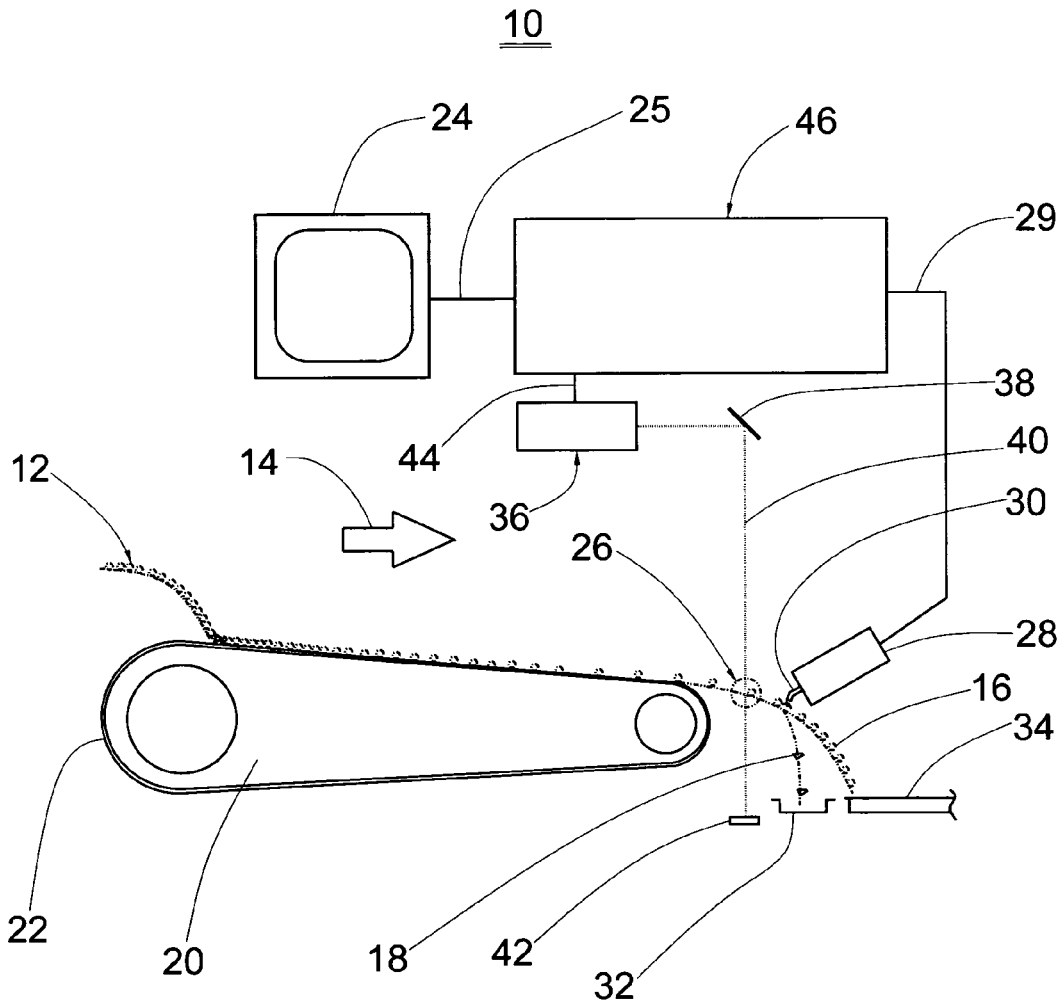
FIG. 1 is a block schematic diagram of the sorting apparatus having the features of the present invention.

Referring now to FIG. 1, an apparatus for sorting articles is shown and is generally identified by the numeral 10. The apparatus is shown in receiving relation to a stream of articles designated as the product stream 12. In practice, for example, the product stream 12 may include comestible items such as vegetables. Yet further the product stream 12 may include other non-organic articles such as glass fragments or wood. The product stream 12 is composed of individual articles traveling in a direction generally depicted by the flow arrow 14. The product stream 12 may include individual articles that are moving in concert at a generally uniform speed and traveling in the product flow direction 14. The individual articles often vary parametrically in dimension, density, color, etc. Often, the quality of an article in a product stream may be ascertained, and may be divided into acceptable articles 16 and undesirable articles 18.

Articles in the product stream 12 are transferred to a conveyor 20 for transport through the apparatus for classifying and sorting articles 10. The conveyor 20 includes an endless belt 22 selected to provide a carrying surface for articles in the product stream 12. The endless belt 22 has a texture which is selected to provide a coefficient of friction useful for stabilizing articles in the product stream 12 as they are transported in the flow direction 14.

The sorting apparatus 10, has a user interface 24 that enables an operator (not shown) to observe and control various operational aspects of the sorting apparatus 10 as will be discussed in further detail below. The user interface 24 may include a CRT or LCD panel for output display. For input, the user interface 24 may include a keyboard, touch-screen or other input means known in the art. The operator can view representations of the articles in the product stream 12 as they are processed in the sorting apparatus 10 on the user interface 24. Yet further, the user interface 24 provides a means for the operator to configure the operation of the sorting apparatus 10 to make a determination between an acceptable article 16 and an undesirable article 18. Data gathered by the user interface 24 and provided to the user interface are transported as user interface data 25.

Articles in the product stream 12 are transported along a path to the end of the conveyor 20 where they are launched in a trajectory through a region of sight 26. The region of sight 26 extends along in transverse relation to the conveyor 20, and has a length that is slightly less than the width of the conveyor 20.

A removal station or ejector manifold 28 is positioned in downstream relation to the region of sight 26, and in fluid transmission relation to the trajectory of the product stream 12. The ejector manifold 28 includes a plurality of ejector nozzles 30 which are individually directed and controlled to selectively remove undesirable articles 18 from the product stream 12. The ejector nozzles 30 act as conduits for directing fluid pulses to dislodge or otherwise re-direct articles traveling in the trajectory. Individual ejector valves contained in the ejector manifold 28 are driven by a plurality of removal signals 29 whose origination and operation will be discussed in further detail below.

Articles that are selectively dislodged from the product stream 12 are guided to a reject conveyor 32 useful for collecting and transporting articles from the product stream 12. In desired operation, the sorting apparatus 10 will direct a high percentage of undesirable articles 18 from the product stream 12 to the reject conveyor 32. However, actual experience has shown that a minority of acceptable articles 16 may also be dislodged by the ejector nozzles 30 and be collected and transported by the reject conveyor 32. In practice, the reject conveyor 32 may be a belt conveyor, vibratory conveyor, chute, flume, or other suitable transport device or arrangement known in the art.

Articles from the product stream 12 that are allowed to proceed in their natural trajectory in the absence of disturbances from the fluid pulses provided by the ejector nozzles 30 travel and are collected and transported by an accept conveyor 34. In desired operation, the sorting apparatus 10 will direct a high percentage of acceptable articles 16 from the product stream 12 to the accept conveyor 34. However, actual experience has shown that a minority of undesirable articles 18 may not be dislodged by the ejector nozzles 30, and hence, be collected and transported by the accept conveyor 34. In practice, the accept conveyor 34 may be a belt conveyor, vibratory conveyor, chute, flume, or other suitable transport device or arrangement known in the art.

Referring still to FIG. 1, a scanning assembly 36 is positioned in light transmission relation to the region of sight 26. A beam of light 40 or other form of electromagnetic radiation is emitted by the scanning assembly 36 and directed by a path folding mirror 38 through the region of sight 26. Often, a portion of light from the beam of light 40 that is reflected or refracted by articles in the product stream 12 is directed along a coincident return path back to the scanning assembly 36.

At other times, a the beam of light 40 proceeds in unimpeded fashion through the region of sight 26 and travels to a background element 42. The background element 42 is composed of a material which reflects, diffuses and refracts light but does not otherwise emit light or electromagnetic radiation. In one embodiment, the background element 42 is composed of an acetal resin having the Delrin registered trademark of the DuPont Corporation. Other materials known by those skilled in the art which suitably reflect, diffuse, and refract light and does not otherwise emit light may be substituted without departing from the scope of this invention. A portion of the beam of light 40 that is refracted or reflected by the background element 42 proceeds along a coincident return path back to the scanning assembly 36.

The scanning assembly 36 provides a plurality of scanning signals 44 that are time sequenced representations of various aspects of the portion of the returned beam of light 40 or other wavelengths of electromagnetic radiation. These aspects of the scanning signals 44 will be discussed in more details below.

A sorting processor 46 is connected in signal and data relation to the user interface 24, the scanning assembly 36, and the ejector manifold 28. The sorting processor 46 is operable to provide real-time command and control of the apparatus 10 in response to the scanning signals 44 and configuration and command information provided by the operator (not shown) via the user interface 24 or other suitable interface means known in the art. The sorting processor 46 provides the plurality of removal signals 29 in response to a plurality of comparative functions operable to classify articles in the product stream 12 as acceptable articles 16 or undesirable articles 18. The sorting process 46 accomplishes this task by gleaning information from the scanning signals 44 and configuration data provided by the user in the form of user interface data 25. The operation of the sorting processor 46 will be discussed in further detail below.

Figure 2:
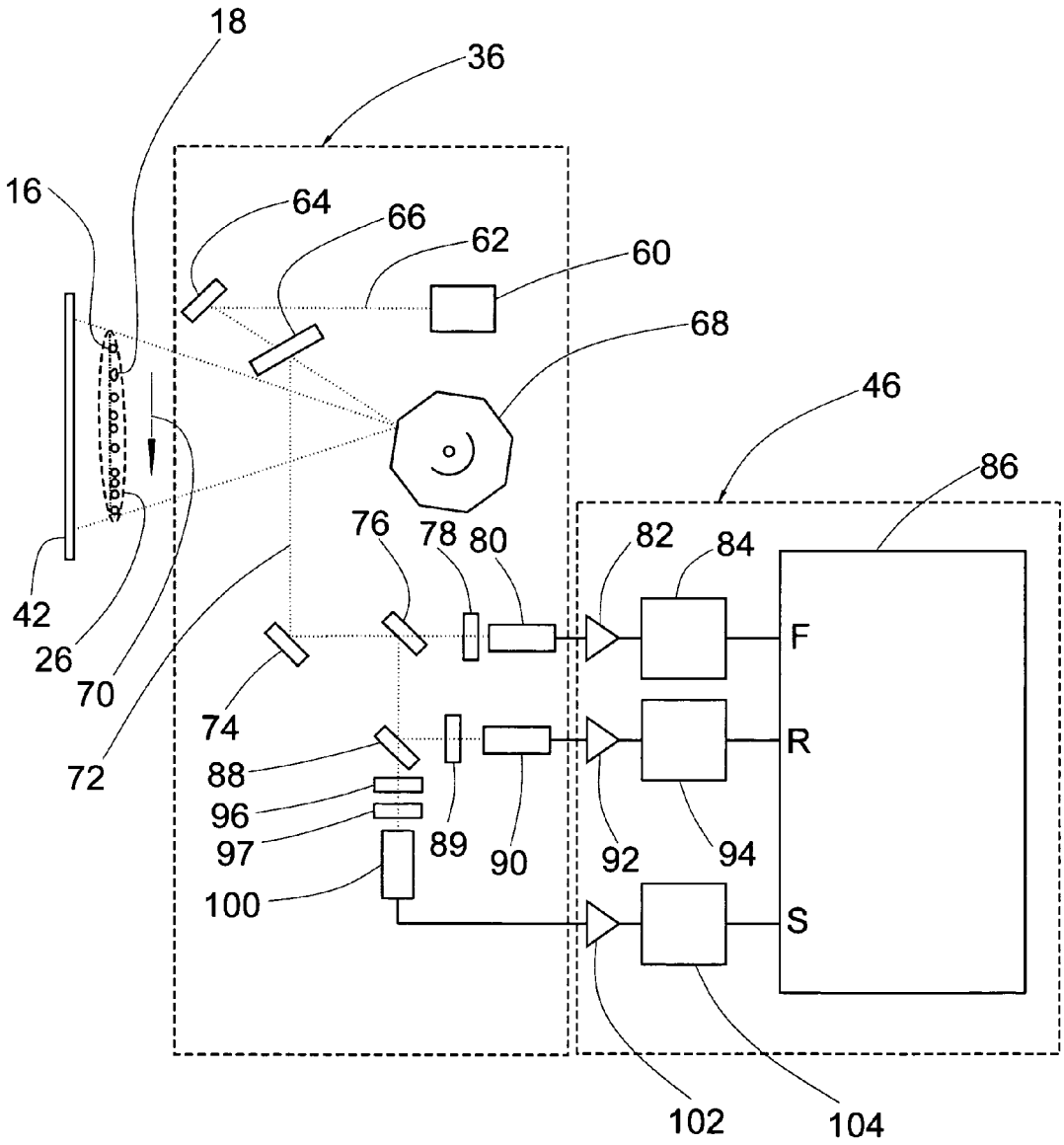
FIG. 2 is a block schematic diagram of the scanning assembly and sorting processor in relation to the background element and the product stream.

Referring now to FIG. 2, the scanning assembly 36 emits a beam of light or other wavelength of electromagnetic radiation that originates from a light source 60. In one embodiment of the invention, the light source 60 is a laser having a central emitting wavelength of approximately 660 nm. The light source 60 preferably includes one or more lasers which are operable to direct a concentrated source beam 62 having a relatively small cross-sectional area.

The source beam 62 interacts with and is reflected by a mirror 64 positioned in reflecting relation to the source beam 62. The source beam 62, after being reflected by the mirror 64, travels through an aperture formed in a splitter mirror 66 which is operable to pass light or other wavelengths of electromagnetic radiation through an aperture formed therein while simultaneously reflecting light or electromagnetic radiation traveling from an opposite direction. Light or electromagnetic radiation that has passed through the splitter mirror 66 interacts with a scanning mirror 68. The scanning mirror 68 may be polygonal in nature, having a number of sides, with the number of sides preferably equal to twelve. The geometry of the scanning mirror 68 is specified to provide a scanning line over a specified distance at a rate that is partially determined by the speed of a motor coupled in rotational relation to the scanning mirror 68 and by the number and size of the mirror sides or facets. It should be understood that the polygonal mirror 68 could be implemented as a galvanic scanner without departing from the scope of this invention.

Light or electromagnetic energy is reflected by the scanning mirror 68 in scanning relation and is directed toward the region of sight as a flying spot which proceeds in transverse relation to the flow direction 14 (FIG. 1), that is in a direction generally indicated by the arrow 70. The articles in the product stream 12 (FIG. 1) containing acceptable articles 16 and undesirable articles 18 interact with a portion of the light or electromagnetic energy projected by the scanning mirror 68. A portion of other light or electromagnetic energy that has passed by articles in the product stream 12 interacts with the background element 42.

Some of the light or electromagnetic energy interacting with the background element 42 and interacting with articles in the product stream 12 is returned by reflection and refraction to the scanning mirror 68. A portion of the light or electromagnetic energy is converted into a longer or shorter wavelength by a fluorescence and/or Raman mechanism during its interaction with some of the articles in the product stream 12. This converted light or electromagnetic energy is emitted by the articles and a portion is propagated or travels also to the scanning mirror 68.

The returned light or electromagnetic energy is reflected by the scanning mirror 68 and directed toward the mirror 64. Here, the light or electromagnetic energy is reflected as returned light or electromagnetic radiation beam and is designated by the numeral 72. The returned light beam 72 is reflected by the return light mirror 74 where it is bent towards a plurality of optical processing elements which will be discussed in further detail below.

The returned light 72 interacts with a spectral splitter 76 which reflects a substantial amount of light or electromagnetic energy having a shorter wavelength than a cutoff wavelength and passes a substantial amount of light or electromagnetic energy having a longer wavelength than the cutoff wavelength. The spectral splitter 76 may be implemented as a dichroic mirror or other type of filter that is known in the art. A substantial portion of the light or electromagnetic energy from the returned light beam 72 having a longer wavelength than the cutoff wavelength passes through the spectral splitter and interacts with a spectral filter 78. The spectral filter 78 is utilized to further refine the spectral content of the light or electromagnetic energy passing therethrough thereby providing a useable signal which is representative of the fluorescing properties of any articles that have interacted with the scanning beam of light or electromagnetic radiation. In one embodiment of the invention, the cutoff frequency of the spectral splitter 76 is 670 nm and the spectral filter 78 is configured to pass frequencies having a wavelength less than 760 nm. Preferably in this embodiment of the invention, the light or electromagnetic radiation that has interacted and passed through the spectral filter 78 will have a desired spectral content having a substantial portion of spectral energy residing at wavelengths between 670 and 760 nm.

The light or electromagnetic energy that passes through the spectral filter 78 is received by a sensor 80 and is converted into a voltage signal that is substantially proportional to the magnitude of the light or electromagnetic energy impinging on its surface. The voltage signal from the sensor 80 is amplified by the fluorescence channel amplifier chain 82 contained as part of the sorting processor 46 which delivers a time varying amplified signal. The signal from the fluorescence channel amplifier chain 82 is transferred to the input of a fluorescence channel analog to digital converter 84 where the signal is digitized and otherwise converted into a digital format. The digitized signal from the fluorescence channel analog to digital converter 84 is routed to a port "F" on the computer 86 as a stream of digital data.

Light or electromagnetic energy that has been reflected by the spectral splitter 76 is directed to a splitter 88. The spectral content of this light contains a preponderance of energy having a wavelength shorter than the cutoff wavelength of the spectral splitter 76. In the embodiment noted above, and with the cutoff wavelength equal to 670 nm, the spectral content of this light will have the vast majority of its spectral energy having a wavelength that is shorter than 670 nm. This light or electromagnetic energy interacts with the beam splitter 88 which acts to divide the light or electromagnetic radiation, passing approximately half of the energy and reflecting the other half of the energy.

The reflected portion of the light or electromagnetic radiation interacts with a bandpass filter 89 that is configured to pass light having a spectral content substantially similar to the spectral content of the light source 60. The light or electromagnetic energy that passes through the bandpass filter 89 is received by a sensor 90 and is converted into a voltage signal that is substantially proportional to the magnitude of the light or electromagnetic energy impinging on its surface. The voltage signal from the sensor 90 is amplified by the reflectance channel amplifier chain 92 contained as part of the sorting processor 46 which delivers a time varying amplified signal. The signal from the reflectance channel amplifier chain 92 is transferred to the input of a reflectance channel analog to digital converter 94 where the signal is digitized and otherwise converted into a digital format as a stream of digital data. The digitized signal from the reflectance channel analog to digital converter 94 is routed to a port "R" on the computer 86, and represents light or electromagnetic radiation that has been reflected by the articles.

The passed or transmitted portion of the light or electromagnetic radiation from the beam splitter 88 then interacts with a filter or field stop 96. The field stop 96 is configured to block light or electromagnetic energy that has been returned in an area of the center of the beam and pass any energy outside this area. In one embodiment, the field stop 96 comprises a 'Mercedes' (trademark) sign shaped diaphragm.

The light or electromagnetic energy that passes through the field stop 96 then interacts with a bandpass filter 97 that is configured to pass light having a spectral content substantially similar to the spectral content of the light source 60. The light or electromagnetic energy that passes through the bandpass filter 97 is received by a sensor 100 and is converted into a voltage signal that is substantially proportional to the magnitude of the light or electromagnetic energy impinging on its surface. The voltage signal from the sensor 100 is amplified by the scatter channel amplifier chain 102 contained as part of the sorting processor 46 which delivers a time varying amplified signal. The signal from the scatter channel amplifier chain 102 is transferred to the input of a scatter channel analog to digital converter 104 where the signal is digitized and otherwise converted into a digital format as a stream of digital data. The digitized signal from the scatter channel analog to digital converter 104 is routed to a port S of the computer 86. For the purpose of this disclosure, the light or electromagnetic radiation that is detected by sensor 100 is referred to as being scattered by the articles because it represents light and electromagnetic energy that has been returned that lies outside a region of the area blocked by the field stop.

In one embodiment, the sensors 80, 90, and 100 are each photomultiplier tubes. However, other types of sensors may be useful in this or other applications without departing from the scope of this invention.

One skilled in the art would recognize that there are other ways that the data streams from the fluorescence channel, scattering channel, and reflectance channel could be obtained without departing from the scope of this invention. For example, other combinations of filtering elements could be re-arranged by adjusting various optical properties of the filter elements to produce similar results.

The computer 86 contains elements that are effective in processing data from the fluorescence, reflectance and scatter channels to provide real-time classification of articles in the product stream 12 as they pass through the region of sight 26 and further contain elements to provide the removal signals 29 which command the individual valves in the ejector manifold 28 to project fluid pulses from the ejector nozzles 30 to selectively remove undesirable articles 18 from the product stream 12. The configuration of parameters useful in the classification process are provided by the interaction of an operator or user (not shown) and the user interface 24.

Figure 3:
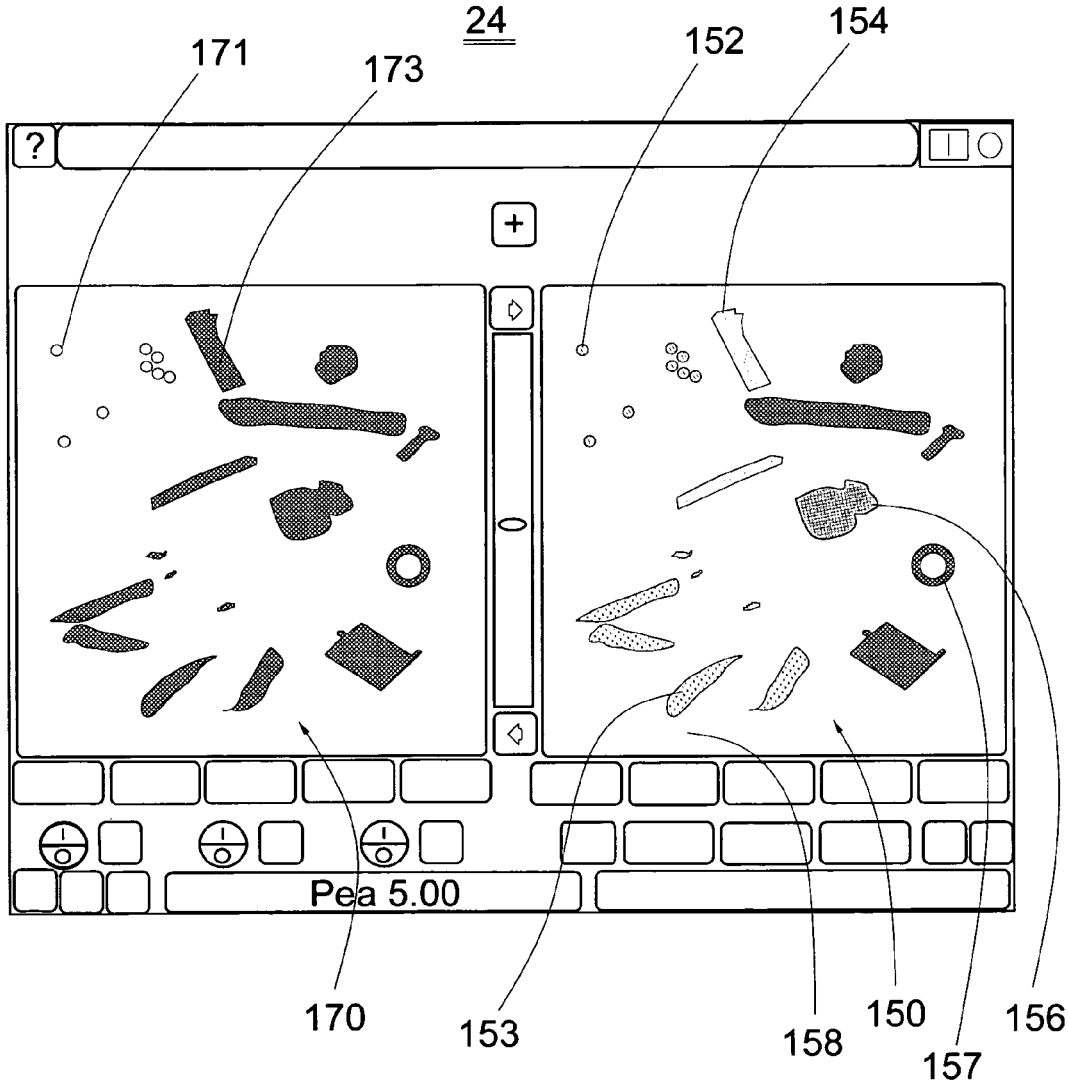
FIG. 3 is a simplified pictorial diagram of the user interface utilized in one aspect of the invention.

Referring now to FIG. 3, the user interface 24 is provided which is operable to display information gathered by the scanning assembly 36 and processed by the computer 86 to an operator. From this information, an operator (not shown) is able to adjust the criteria that are utilized by the computer 86 to differentiate between acceptable articles 16 and undesirable articles 18. In addition, the user interface is operable to display and illustrate to the operator how the computer 86 would process the articles and further to provide a visual indication of which articles are acceptable and which articles are undesirable. In this manner, it is possible for an operator to configure the sorting apparatus 10 with the capability of making subtle distinctions between articles that other sorting machines found in the art cannot make on a repeatable basis. In addition, the sorting criteria can be saved as a distinct setup or recipe by an operator. This setup or recipe can be recalled at a later time, providing for rapid switching between various types of articles, or to respond to other variations within the product stream 12.

Referring now to FIGS. 2 and 3, the computer 86 is further operable to provide image data of articles in the product stream 12 for display on the user interface 24 as shown on the right hand display 150 of FIG. 3. This image data is produced by assembling and transforming data from the fluorescence, scatter, and reflection channels. In one embodiment, this transformation is accomplished by assigning specific display colors to each channel, thereby representing the image in a virtual color environment while preserving the spatial relationships of articles in the product stream, having gleaned this information from the timing and scanning parameters of the individual channel data streams.

In one embodiment, the fluorescence channel is assigned as the color "green", the scatter channel is assigned the color "red", and the reflection channel is assigned the color "blue".

In this transformation environment, the background element 42 is displayed as solid red since it does not emit, and does not fluoresce and is selected to provide a high degree of scattering. An article with abundant fluorescence (for example, an article with chlorophyll like peas) will be displayed as a green article in the user interface 24, and is shown in FIG. 3 using diagonal hatching pattern and is indicated by the numeral 152. An article such as a pea pod, has less fluorescence, and will be displayed on the user interface 24 in darker color, and is shown in FIG. 3 with a speckled hatch pattern and is indicated by the numeral 153. An article such as a stone or other dark colored foreign material will be displayed in a black color on the user interface 24 since they do not fluoresce and have relatively low scattering and specular reflective properties, and are shown in FIG. 3 in a densely hatched pattern and is indicated by the numeral 156. Articles such as metal which having a high degree of specular reflectivity are displayed in blue on the user interface 24, and are shown with a cross hatching pattern and are generally indicated by the numeral 157. Articles such as certain types and colors of plastics and soft transparent rubber are displayed on the user interface in a purple color since they exhibit a high degree of scattering, and are shown in a light speckle hatching pattern as generally indicated by the numeral 154.

The user interface 24 and computer 86 are equipped with hardware and computer readable programs to enable an operator (not shown) to configure a segmentation or classification engine (not shown) by assigning individual colors to acceptable regions and undesirable regions. In this way, the operator is able to teach the sorting apparatus 10 to designate certain articles in the product stream 12 as acceptable articles 16 and undesirable articles 18. The left hand graphic window 170 in FIG. 3 displays the results of this segmentation or classification operation as a classification image, providing valuable feedback to the operator. In one embodiment, the objects detected to be acceptable articles generally indicated by the numeral 171 are displayed as white on the user interface 24, and in FIG. 3 are shown without hatching. Articles that are detected and determined to be undesirable articles are shown in blue on the user interface 24, and in FIG. 3 are shown in a cross hatched pattern as generally indicated by the numeral 173. The computer 86 is configured to combine the scatter and reflection signals to determine the background signal which is represented by the color grey on the user interface 24.

Operation

The operation of the present invention is believed to be readily apparent and is briefly summarized in the paragraphs which follow.

Articles in the product stream 12 are conveyed on the endless belt 22 of the conveyor 20. Light or electromagnetic radiation having a first wavelength is provided by the optical scanner 36 and is directed toward articles in the product stream 12 by the mirror 38. Light or electromagnetic radiation that is reflected, refracted or converted by fluorescent or other emission is returned to the mirror 38, and to the optical scanner 36. Some of the light that is not returned, interacts with the background element 42, where a portion is returned to the mirror 38, and to the optical scanner 36.

Light or electromagnetic radiation that is returned from articles in the product stream 12 having a wavelength that is longer than the first wavelength is converted into a first signal by the optical scanner 36. Light or electromagnetic radiation having the first wavelength that is reflected by articles in the product stream 12 and from the background element 42 is converted into a second signal by the optical scanner 36. Light or electromagnetic radiation having the first wavelength that is scattered by articles in the product stream 12 and from the background element 42 is converted into a third signal by the optical scanner.

Then, the first, second, and third signals are transformed into a first, second, and third data streams representing the time varying magnitude of each of the signals, and represent the fluorescence channel, reflectance channel, and scatter channel respectively. The data streams are presented to the computer 86 and processed in a manner that will be discussed in more detail below.

Figure 4:
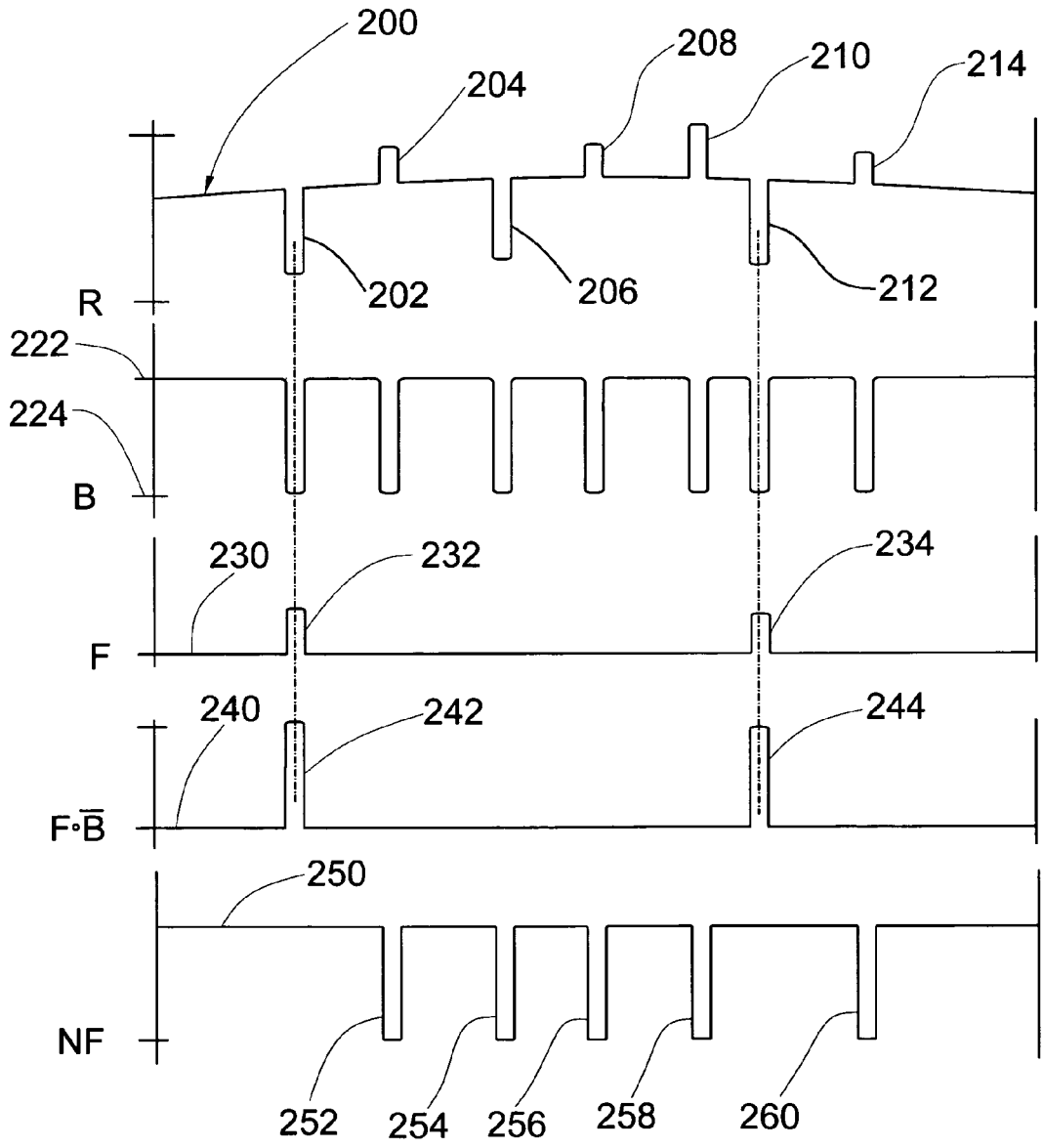
FIG. 4 is a time-chart representation of the magnitude of selected signals and data streams that are generated by the scanning assembly in response to light or electromagnetic radiation that is emitted, reflected, and scattered by articles in a product stream and a background element.
Figure 5:
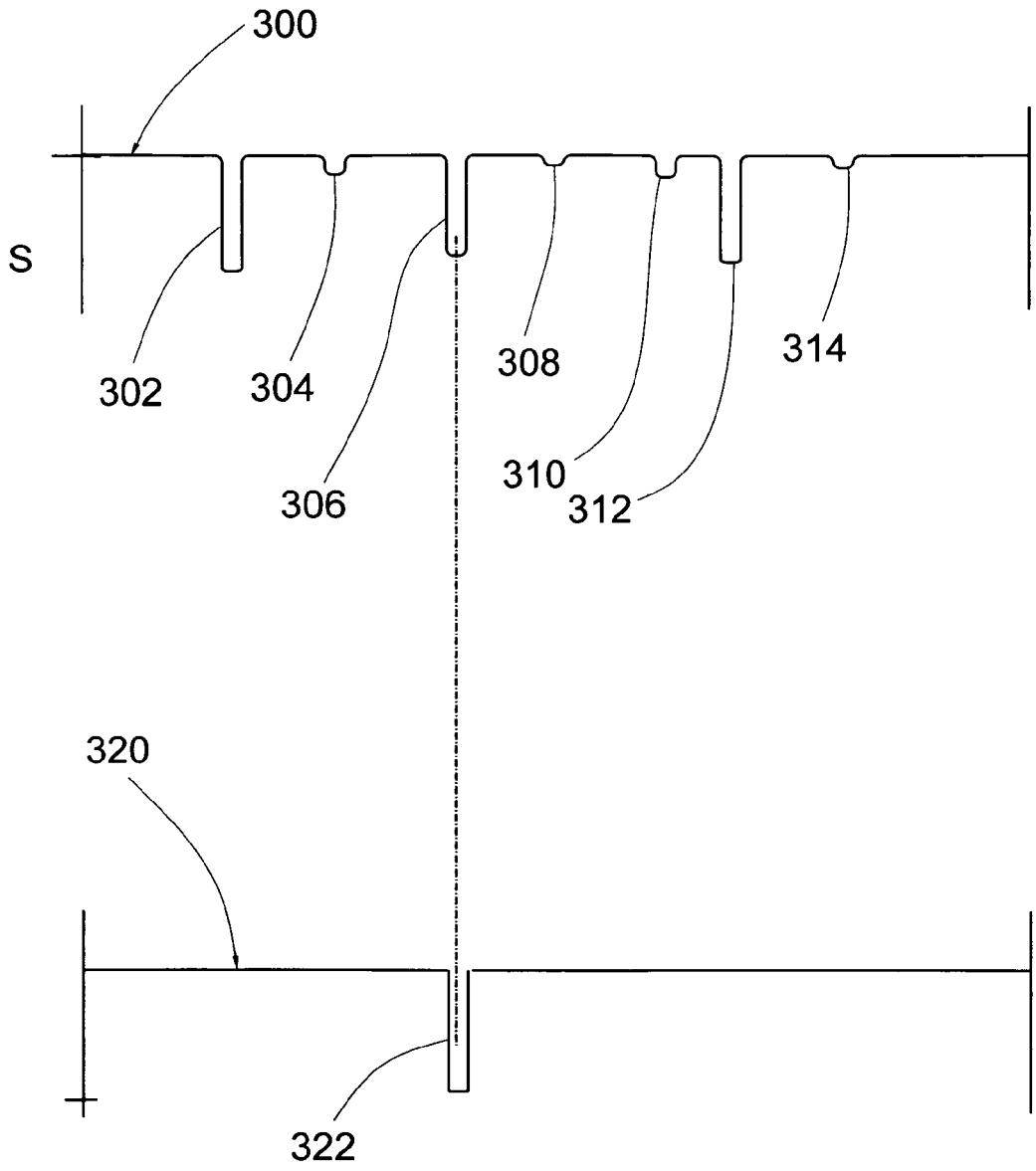
FIG. 5 is a time-chart representation of the magnitude of selected signals and data streams that are generated by the scanning assembly in response to light or electromagnetic radiation that is emitted, reflected, and scattered by articles in a product stream and a background element.

Referring to FIGS. 4 and 5 each include a set of time ordered charts representing data formed into a trace from one scan line of the scanning assembly 36 (FIG. 2) of the data streams presented to the computer 86. Now referring to FIGS. 3, 4 and 5, the reflectance channel "R" is shown in FIG. 4, and is designated by the numeral 200. The scatter channel "S" is shown in FIG. 5, and is designated by the numeral 300. The fluorescence channel "F" is shown in FIG. 4, and is designated by the numeral 230.

The notches 202 and 212, 302, 312, and peaks 232 and 234 are realized as articles pass through the region of sight 26 (FIGS. 1, 2). In this example, these articles exhibit low reflectance, low levels of scattering, and high levels of fluorescence. In this example, these articles are peas and are displayed in a green color (diagonal hatching) on the user interface 24 because of their high level of fluorescence, and are designated by the numeral 152 (FIG. 3). Other materials which exhibit similar characteristics could include beans and spinach greens. In addition, articles such as pea pods are displayed in a darker shade of green (shown with small triangle hatching) and are designated with the number 153. In this case, it is possible for an operator to configure the sorting apparatus 10 to differentiate between various types of articles based on fluorescence, scattering, and reflective properties so, as an example, pea pods could be differentiated and sorted from peas in a product stream 12.

The peaks 204, 208, 210 and 214, and the notches 304, 308, 310, and 314 are realized as articles pass through the region of sight 26 having high reflectance, scattering and little or no fluorescence. In this example, these articles are blank or untreated wood, white translucent stone or colored plastics and are displayed on the user interface 24 in a mixture of red and blue yielding various shades of purple. These articles are shown in a speckled hatching format, and designated by the numeral 154. Materials exhibiting these properties could include blank or untreated wood.

The notches 206 and 306 are realized as an article passes through the region of sight 26 having a dark, non-reflecting and non-scattering characteristic with little or no fluorescence. In this example, this article is a piece of black rubber and is displayed on the user interface 24 as a dark or black color. This article is shown in dense cross shading, and designated by the numeral 156.

All other points along the traces 200, 230, and 300 result from light or other electromagnetic energy interacting with the background element 42 (FIGS. 1, 2). This background element 42 exhibits a high degree of scatter, a mid level of reflectivity and no appreciable fluorescence. The background element 42 is visible on the user interface 24 and appears as a red color on the user interface, and is designated by the numeral 158.

The computer 86 (FIG. 2) is programmed and operable to utilize data from the reflectance channel "R", and the scatter channel "S", to provide a determination regarding whether the returned light or electromagnetic radiation has interacted with the background. This determination is accomplished by comparing a previously trained and internally stored nominal background data stream or set with data from the reflectance channel "R" and the scatter channel "S". This previously trained background data stream or set represents the measured background level during a setup operation. The "B" trace 220 is a representation of this determination, with a high level 222 indicating the interaction with the background element 42, while a low level 224 indicates an interaction with articles in the region of sight 26 rather than an interaction with the background element 42.

Yet further, a time ordered chart representing a logical combination of the fluorescence channel having exceeded a threshold, and logically AND'ed with the compliment of the background signal 220 is shown in the trace 240. Here, the peaks 242 and 244 represent peas that have passed through the region of sight 26 and are designated as acceptable articles 16.

Next, a trace 250 is shown being a logical combination of the background trace 220 and the trace 240. Notches 252, 254, 256, 258, and 260 represent undesirable articles 18.

Finally, a trace 320 is shown being a logical combination of the scatter channel trace 300, background trace 220 and the trace 240. Here the notch 322 corresponds to the article 156 as displayed on the user interface, which could similarly be designated as an undesirable article 18. As noted earlier, the computer 86 is operable to act to remove the undesirable article 18 by generating a command which controls a specific valve in the ejector manifold 28 to direct blasts of fluid at the unacceptable article 18 to effectively remove it from the product stream 12.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A sorting apparatus for selectively removing undesirable articles from a product stream, comprising:

a conveyor positioned in transporting relation to the product stream;

a removal station positioned proximate to the product stream;

a background element positioned proximate to the product stream;

an optical scanner configured to project electromagnetic radiation having a preponderance of energy at a first wavelength onto the product stream and the background element;

a first sensor configured to convert or electromagnetic radiation returned from articles in the product stream having a wavelength that is longer than the first wavelength into a first signal;

a second sensor configured to convert electromagnetic radiation having the first wavelength that is reflected by articles in the product stream and from the background element into a second signal;

a third sensor configured to convert electromagnetic radiation having the first wavelength that is scattered by articles in the product stream and from the background element into a third signal;

a sorting processor connected to the removal assembly and operable to receive the first, second, and third signals; and wherein the sorting processor is configured to convert each of the first, second, and third signals into a first, second, and third data stream and wherein the sorting processor is operable to provide a virtual background data stream by performing a logical comparison of an internally stored nominal background data stream and the second data stream; and a user interface connected in data communication to the sorting processor.

2. The sorting apparatus as claimed in claim 1, and wherein the background element is composed of a plastic material including acetal resin.

3. The sorting apparatus as claimed in claim 1, and wherein the sorting processor is operable to provide a virtual desirable data stream by logically combining an inverse of the virtual background signal AND the third data stream.

4. The sorting apparatus as claimed in claim 3, and wherein the sorting processor is operable to provide a virtual reject data stream by logically combining data from the virtual desirable signal and the virtual background data stream to classify articles as desirable and undesirable.

5. The sorting apparatus as claimed in claim 4, and wherein the sorting processor is further operable to transform the virtual reject data stream into specific sequenced commands that control the removal station to selectively remove undesirable articles from the product stream.

6. The sorting apparatus as claimed in claim 5, and wherein the user interface is operable to display the first, second, and third data streams as a virtual image of the articles, and wherein colors are assigned to each of the first, second, and third data streams.

7. The sorting apparatus as claimed in claim 6, and wherein the first data stream is represented by the color green, and the second data stream is represented by the color blue, and the third data stream is represented by the color red.

8. The sorting apparatus as claimed in claim 6, and wherein the user interface is operable to acquire information from a user relating to the undesirability or acceptability of the displayed articles, and wherein this information is provided to the sorting processor and utilized in the classification of articles in the product stream.

9. The sorting apparatus as claimed in claim 8, and wherein the user interface is operable to display a classification image which portrays articles classified as acceptable in a first color, and articles classified as undesirable in a second color.

10. A sorting apparatus for selectively removing undesirable articles from a product stream, comprising:

a conveyor positioned in transporting relation relative to the product stream;

a removal station positioned proximate to the product stream;

a background element positioned proximate to the product stream;

a scanning assembly configured to project electromagnetic radiation onto the product stream and the background element, and further configured to receive electromagnetic radiation that is reflected by the background element, and to receive electromagnetic radiation that is reflected and/or emitted by articles in the product stream, and wherein the scanning assembly is configured to emit electromagnetic energy having a preponderance of energy at a first wavelength, and further wherein the scanning assembly comprises:

a first channel configured to measure electromagnetic radiation returned from articles in the product stream having a wavelength is longer than the first wavelength;

a second channel configured to measure electromagnetic radiation reflected by articles in the product stream and from the background;

and a third channel configured to measure electromagnetic radiation that is scattered by articles in the product stream and from the background;

a sorting processor connected to the scanning assembly and removal assembly, and operable to receive data from the scanning assembly, and operable to provide a virtual image of the articles, and wherein colors are assigned to each of the first, second, and third channels of the scanning assembly, and wherein the sorting processor is further operable to compare this data with user defined sorting criteria operable to classify articles in the product stream as either undesirable articles or acceptable articles, and further is operable to transform the classification of articles into specific sequenced commands that control the removal station to selectively remove undesirable articles from the product stream; and a user interface connected in data communication to the sorting processor and operable to display the virtual image in conjunction with an adjacent classification image in which portrays the result of the classification of the articles, and further provides an interface to receive information from a user relating to the undesirability or acceptability of the displayed articles, and wherein the information is provided to the sorting processor and utilized in the classification of articles in the product stream.

11. The sorting apparatus as claimed in claimed 10, and wherein the first wavelength is 660 nm.

12. The sorting apparatus as claimed in claim 11, and wherein the first channel is configured to pass a wavelength of between 670 nm and 760 nm.

13. The sorting apparatus as claimed in claim 10, and wherein the sorting processor is operable to provide a virtual background signal by comparing a previously trained and internally stored nominal background signal level with data from the second channel.

14. The sorting apparatus as claimed in claim 13, and wherein the sorting processor is operable to provide a virtual desirable signal by logically combining an inverse of the virtual background signal AND with data from the third channel.

15. The sorting apparatus as claimed in claim 14, and wherein the sorting processor is operable to provide a virtual reject signal by logically combining data from the virtual desirable signal and data from the virtual background signal.

16. A sorting method for selectively removing undesirable articles from a product stream, comprising:

providing an optical scanner;

providing a sorting processor in signal communication with the optical scanner;

providing a passive background element positioned proximate to the product stream;

projecting electromagnetic radiation from the optical scanner having a preponderance of energy at a first wavelength onto the product stream and the background element;

converting electromagnetic radiation returned from articles in the product stream having a wavelength that is longer than the first wavelength into a first signal by the optical scanner;

converting electromagnetic radiation having the first wavelength that is reflected by articles in the product stream and from the background element into a second signal by the optical scanner;

converting electromagnetic radiation having the first wavelength that is scattered by articles in the product stream and from the background element into a third signal by the optical scanner;

transforming each of the first, second, and third signals into a first, second and third data stream that is representative of the time varying magnitude of each of the signals in the sorting processor;

providing a virtual background data stream by performing a logical comparison of an internally stored nominal background data stream and the second data stream in the sorting processor;

providing a virtual desirable data stream by logically combining an inverse of the virtual background signal AND the third data stream in the sorting processor; and providing a virtual reject data stream by logically combining data from the virtual desirable signal and the virtual background data stream to classify articles as desirable and undesirable in the sorting processor.

* * * * *